US005736072A

United States Patent [19]

Satoh

[11] Patent Number: 5,736,072

[45] Date of Patent: Apr. 7, 1998

[54] DEVICE FOR PRODUCING CARBONATED WATER

[75] Inventor: Takeshi Satoh, Sawa-gun, Japan

[73] Assignee: Sanden Corporation, Isesaki, Japan

[21] Appl. No.: 728,609

[22] Filed: Oct. 10, 1996

[30] Foreign Application Priority Data

Oct. 17, 1995 [JP] Japan ..... 7-268417
Oct. 18, 1995 [JP] Japan ..... 7-270240

[51] Int. Cl.[6] ..... B01F 3/04

[52] U.S. Cl. ..... 261/27; 261/123; 261/119.1; 261/DIG. 7

[58] Field of Search ..... 261/DIG. 7, 27, 261/123, 119.1

[56] References Cited

U.S. PATENT DOCUMENTS

| | | | |
|---|---|---|---|
| 722,368 | 3/1903 | Lee et al. | 261/DIG. 7 |
| 772,484 | 10/1904 | Watson | 261/DIG. 7 |
| 903,297 | 11/1908 | Leuschner | 261/DIG. 7 |
| 998,428 | 7/1911 | Stuhler | 261/DIG. 7 |
| 2,081,029 | 5/1937 | Young | 261/DIG. 7 |
| 3,403,523 | 10/1968 | Bauer et al. | 261/DIG. 7 |
| 5,259,997 | 11/1993 | Kazuma | 261/DIG. 7 |

FOREIGN PATENT DOCUMENTS

| | | | |
|---|---|---|---|
| 458045 | 1/1950 | Italy | 261/DIG. 7 |
| 62-199124 | 12/1987 | Japan . | |
| 5-92132 | 4/1993 | Japan . | |
| 2059791 | 4/1981 | United Kingdom | 261/DIG. 7 |

*Primary Examiner*—Tim R. Miles
*Attorney, Agent, or Firm*—Banner & Witcoff, Ltd.

[57] ABSTRACT

The present invention is directed to a device for producing carbonated water. The device includes a hermetic container, a first pipe member continually conducting a carbonic acid gas into an inner hollow space of the hermetic container, a second pipe member intermittently conducting pressurized water into the inner hollow space of the hermetic container in response to demand, and a third pipe member intermittently conducting carbonated water temporarily staying in the container to a location outside of the container in response to demand. A nozzle is connected to one end of the second pipe member and is disposed within the container at a top end thereof. The nozzle has a plurality of holes which allow the pressurized water to be downwardly injected into the inner hollow space of the container. A plate member may be disposed within the inner hollow space of the container. The plate member includes a first hole which is located at a position corresponding to a downward path of the injected water, and at least one second hole which is located at a position offset from an upward path of the injected water.

7 Claims, 3 Drawing Sheets

DEVICE FOR PRODUCING CARBONATED WATER

BACKGROUND OF THE INVENTION

1. Technical Field of the Invention

This invention generally relates to a beverage dispenser, and more particularly, to a device for producing carbonated water to be used in the beverage dispenser.

2. Description of the Prior Art

In general, beverage dispensers which can serve carbonated beverages are equipped with a device for producing carbonated water therewithin (for purposes of explanation only, the device will be named "carbonater" hereafter). Such carbonaters are well-known in the art, such as, for example, that described in Japanese Utility Model Application Publication No. 62-199124, the entire contents of which are hereby incorporated by reference.

A conventional carbonater, as described in the above Japanese Utility Model Application Publication and shown herein as FIG. 7, includes a hermetic container 1 filled with a carbonic acid gas that is continually supplied through a pipe member 3, and a nozzle 2 which is fixedly and hermetically connected to a top end of the container 1. The nozzle 2 is linked to a faucet of a water service pipe through another pipe member via a pump, and has a single hole through which water is injected.

In operation, water supplied from the water service pipe through another pipe member is intermittently injected into the container through the hole of the nozzle 2 in response to demand. The water injected through the nozzle 2 is thrust into water which has already been injected into and is temporarily staying in the container 1. Thereafter, the injected water moves through the water temporarily staying in the container by virtue of the inertia thereof, as described below.

The injected water initially moves downwardly until it reaches the bottom of the container. Once the injected water reaches the bottom of the container, it moves horizontally outwardly in various directions along the bottom of the container until it reaches an inner peripheral surface of a side wall of the container. Once the injected water reaches the inner peripheral surface of the side wall of the container, it moves upwardly to the surface of the temporarily staying water.

As the injected water thrusts into the temporarily staying water, part of the carbonic acid gas filling the inner hollow space of the container is dragged into the temporarily staying water. The majority of the carbonic acid gas dragged into the temporarily staying water moves therethrough together with the injected water. As a result, the water (both the injected water and the temporarily staying water) and the carbonic acid gas are dynamically in contact with each other as the injected water moves through the temporarily staying water, and thus the carbonic acid gas should be effectively dissolved in the water.

However, since there is only one hole in the nozzle, the water is injected into the container through the nozzle as a single column. Therefore, the column of water which will thrust into the temporarily staying water has a relatively large mass. Accordingly, the inertia of the single column of the injected water has a relatively large value and the speed of the injected water as it moves through the temporarily staying water becomes relatively fast. As a result, the water and the carbonic acid gas are only dynamically in contact with each other for a relatively short time period, and thus the carbonic acid gas may be insufficiently dissolved in the water.

SUMMARY OF THE INVENTION

Accordingly, it is an object of the present invention to provide a device for producing carbonated water in which carbonic acid gas is sufficiently dissolved in the water.

A device for producing carbonated water according to the present invention includes a hermetic container, a first pipe member continually conducting a carbonic acid gas into an inner hollow space of the hermetic container, a second pipe member intermittently conducting pressurized water into the inner hollow space of the hermetic container in response to demand, a third pipe member intermittently conducting the carbonated water temporarily staying in the container to a location outside of the container in response to demand, and a nozzle connected to one end of the second pipe member to be disposed within the container at a position which is located at a top end of the container.

The nozzle has a plurality of, for example, three holes which allow the pressurized water to be downwardly injected into the inner hollow space of the container.

The device may further include a plate member disposed within the inner hollow space of the container. The plate member includes a first hole which is located at a position corresponding to a downward path of the injected water, and at least one second hole which is located at a position offset from an upward path of the injected water.

DETAILED DESCRIPTION OF THE PREFERRED EMBODIMENTS

Figure 1:
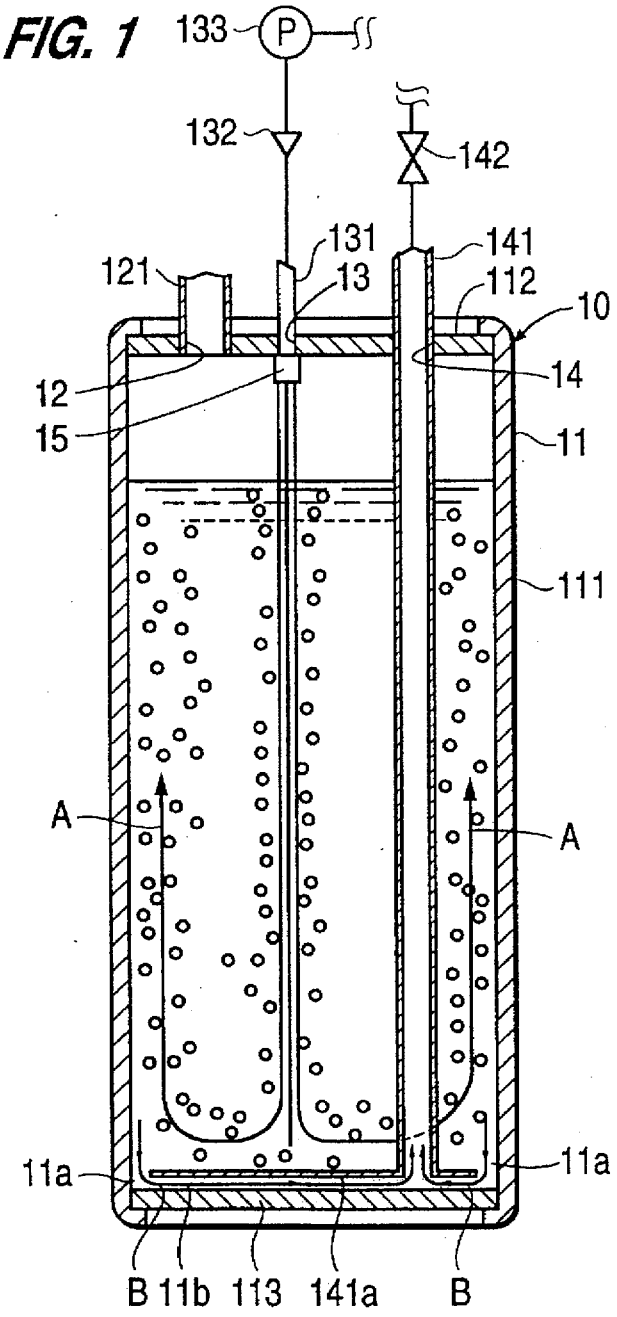
FIG. 1 is an overall longitudinal cross-sectional view of a device for producing carbonated water in accordance with a first embodiment of the present invention.
Figure 2:
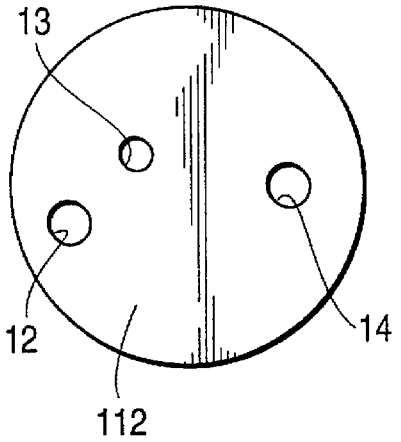
FIG. 2 is a top view of an upper discoid portion of a container shown in FIG. 1.

FIG. 1 illustrates an overall construction of a carbonater 10 in accordance with a first embodiment of the present invention. With reference to FIG. 1, the carbonater 10 includes a container 11 which is made of, for example, stainless steel and comprises a cylindrical portion 111 and upper and lower discoid portions 112 and 113. The upper discoid portion 112 is fixedly and hermetically connected to a top end of cylindrical portion 111. Similarly, the lower discoid portion 113 is fixedly and hermetically connected to a bottom end of cylindrical portion of container 111. First, second and third circular holes 12, 13, and 14 are formed through the upper discoid portion 112 of container 11. The locations of the holes, 12, 13 and 14 are arranged as illustrated in FIG. 2.

A first pipe member 121 links an inner hollow space of the container 11 to an external carbonic acid gas bomb (not shown) in fluid communication. One end of the first pipe member 121 is fixedly and hermetically connected to an inner periphery of the first hole 12. The other end of the first pipe member 121 is connected to a reducing valve (not shown) which is associated with an outlet port of the carbonic acid gas bomb (not shown). The reducing valve operates to reduce the pressure of the carbonic acid gas to, for example, about 5 $Kg/cm^2$.G, when the carbonic acid gas passes therethrough from the carbonic acid gas bomb. Accordingly, carbonic acid gas having a pressure of about 5 $Kg/cm^2$.G can be conducted into the inner hollow space of the container 11 from the carbonic acid gas bomb (not shown) through the first pipe member 121 via the reducing valve. Furthermore, fluid communication between the carbonic acid gas bomb (not shown) to the inner hollow space of the container 11 is always open, so that the inner hollow space of the container 11 is always filled with carbonic acid gas having a pressure of about 5 $Kg/cm^2$.G.

A second pipe member 131 links the inner hollow space of container 11 to a water service pipe (not shown) in fluid communication. One end of the second pipe member 131 is fixedly and hermetically connected to an inner periphery of the second hole 13. The other end of second pipe member 131 is connected to a faucet (not shown) of the water service pipe via a pump 133, which operates to pressurize the incoming tap water to, for example about 9 $Kg/cm^2$.G. Accordingly, the pressurized water can be conducted into the inner hollow space of the container 11 from the water service pipe via the pump 133. Furthermore, a check valve 132 is disposed within the second pipe member 131 at a location between the pump 133 and one end of the second pipe member 131.

A third pipe member 141 links the interior of container 11 in fluid communication with a location outside of the container 11. One end of the third pipe member 141 penetrates through the third hole 14 of the upper discoid portion 112 of the container 11, and downwardly extends through the inner hollow space of the container 11 generally parallel to the longitudinal axis of the container 11, and finally terminates at a position adjacent to an upper end surface of the lower discoid portion 113. The mating surfaces between the upper discoid portion 112 of the container 11 and the third pipe member 141 are fixedly and hermetically connected to each other. The third pipe member 141 includes a circular discoid portion **141*a* formed at one end thereof. The circular discoid portion 141*a* extends along a plane parallel to the lower discoid portion 113, such that a small annular air gap 11*a* is created between an outer periphery of the circular discoid portion 141*a* and an inner peripheral surface of the cylindrical portion 111 of the container 11, and such that a small air gap 11*b* is created between a lower end surface of the circular discoid portion 141*a* and the upper end surface of the lower discoid portion 113 of the container 11. The other end of the third pipe member 141 terminates at a location exterior to container 11 where a concentrated raw beverage and the carbonated water are mixed with each other. Furthermore, a valve element 142 is disposed within the third pipe member 141 at a location exterior to the container 11. The valve element 142** is opened and closed by virtue of operation of a control device (not shown).

Figure 3:
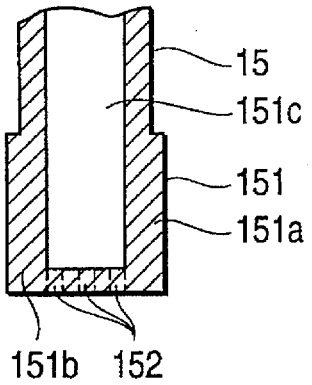
FIG. 3 is an enlarged cross-sectional view of a nozzle shown in FIG. 1.
Figure 4:
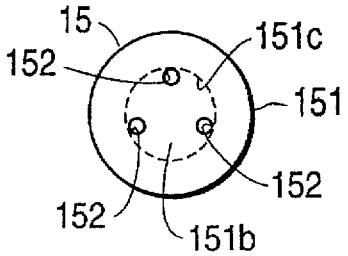
FIG. 4 is a bottom view of the nozzle shown in FIG. 3.

With reference to FIGS. 3 and 4 in addition to FIG. 1, a nozzle 15 is disposed within the inner hollow space of the container 11 at a position adjacent to a lower end surface of the upper discoid portion 112 of the container 11. The nozzle 15 includes a body element 151, which comprises an annular cylindrical portion **151*a* and a circular flat bottom portion 151*b* connected to a lower end of the annular cylindrical portion 151*a*. Thus, a cylindrical hollow space 151*c* is defined by the annular cylindrical portion 151*a* and the circular flat bottom portion 151*b***.

A plurality of, for example, three identical holes 152 are formed through the circular flat bottom portion **151*b* of the body element 151 of the nozzle 15. The holes 152 are arranged to be located along an inner peripheral surface of the annular cylindrical portion 151*a* of the body element 151 with equiangular intervals. An upper end portion of the body element 151 of the nozzle 15 is fixedly and hermetically connected to one end of the second pipe member 131. Accordingly, the pressurized incoming tap water can be conducted, such as by injection, into the inner hollow space of the container 11 through the second pipe member 131 and nozzle 15**.

Furthermore, in order to sense a level of the carbonated water which temporarily stays in the container 11, carbonater 10 is provided with a float switch (not shown) which is operatively disposed within the container 11. The float switch is turned on when the level of the water in the container 11 decreases to a first boundary value, and is turned off when the level of the water in the container 11 increases to a second boundary value which is higher than the first boundary value.

In operation of the carbonater 10, when the carbonated water is required to be supplied to the mixing location outside of the container 11, the control device (not shown) operates to open the valve element 142, so that the carbonated water temporarily staying in the container 11 flows from inside the container to the exterior of the container 11 through the third pipe member 141 by virtue of the pressure force of the carbonic acid gas filled with the inner hollow space of the container 11. In this flowing manner, as indicated by arrows "B" in FIG. 1, the carbonated water temporarily staying in the container 11 is taken into one end of the third pipe member 141 via gaps **11*a* and gaps 11*b*, and flows upwardly through the third pipe member 141. This operation continues until a time when the amount of the carbonated water flowing from the interior of container 11 to the location outside of the container 11 reaches the demanded value. The carbonated water flowing to the location outside of the container 11** is mixed with the concentrated raw beverage in a well-known manner.

As the carbonated water continually flows from the interior of container 11 to the location outside of the container 11, the level of carbonated water in the container 11 gradually decreases. When the level of carbonated water in the container 11 decreases to the first boundary value, the float switch (not shown) is turned on. When the float switch is turned on, the pump 133 begins to operate. As a result, the incoming tap water will be conducted into the container 11 from the water service pipe (not shown) through the second pipe member 131 via the pump 133 and the check valve 132. This operation continues until a time when the level of carbonated water in the container 11 increases to the second boundary value, at which time the float switch is turned off. As the float switch is turned off, the operation of the pump 133 is terminated. As a result, the flow of the incoming tap water from the water service pipe (not shown) to the container 11 of the carbonater 10 through the second pipe member 131 is terminated.

As long as the incoming tap water flows from the water service pipe (not shown) to the container 11 through the second pipe member 131, the pressurized water is downwardly injected into the inner hollow space of the container 11 through nozzle 15, and thrusts into the water, which has already been injected and is temporarily staying in the container 11. Thereafter, the injected water moves through the temporarily staying water in the container 11 as indicated by arrows "A" in FIG. 1 by virtue of the inertia thereof.

In detail, the injected water initially moves downwardly until it reaches the circular discoid portion 141*a* of the third pipe member 141. Once the injected water reaches the circular discoid portion 141*a*, it turns to a horizontal direction, and then moves horizontally outwardly in various radial directions along the upper end surface of the circular discoid portion 141*a* until it reaches an inner peripheral surface of cylindrical portion 111 of the container 11. Once the injected water reaches the inner peripheral surface of cylindrical portion 111 of the container 11, it turns to the upward direction, and finally moves upwardly to the top surface of the temporarily staying water in the container 11 along the inner peripheral surface of cylindrical portion 111 of the container 11.

As the injected water is thrust into the temporarily staying water, a part of the carbonic acid gas filling the inner hollow space of container 11 is dragged into the temporarily staying water. The majority of the carbonic acid gas dragged into the temporarily staying water moves therethrough together with the injected water.

According to the first embodiment of the present invention, since the nozzle 15 has three identical holes 152, the water is injected into the inner hollow space of the container 11 through the identical three holes 152 of the nozzle 15 as three separate columns. Therefore, each of the columns of water which will be thrust into the temporarily staying water has a relatively small mass. Accordingly, the inertia of each of the three columns of the injected water has relatively small value and the speed of the injected water moving through the temporarily staying water become relatively slow. As a result, the water (both the injected water and the temporarily staying water) and the carbonic acid gas are dynamically in contact with each other for a relatively long time period. Therefore, the carbonic acid gas and the water sufficiently contact each other, so that the carbonic acid gas can be sufficiently dissolved in the water.

According to the measuring results, the carbonater 10 of the first embodiment can dissolve the carbonic acid gas in the water at 3.9 vol. % on average.

Furthermore, in this embodiment, the speed of the water being injected through each of the holes 152 of the nozzle 15 (i.e., the mass flow rate of the water being injected through the nozzle 15) is selected such that the incoming water can compensate for a decrease of the temporarily staying water in the container 11 within a predetermined certain time period once the surface level of the temporarily staying water in the container 11 is lowered to the first boundary value.

Moreover, in the present invention, the number of holes 152 of the nozzle 15 is not restricted to that of the first embodiment. The number of holes 152 of the nozzle 15 can be freely selected as long as the inertia of each of the columns of the injected water has a sufficiently small value so as to assure the sufficient dissolution of the carbonic acid gas into the water.

Figure 5:
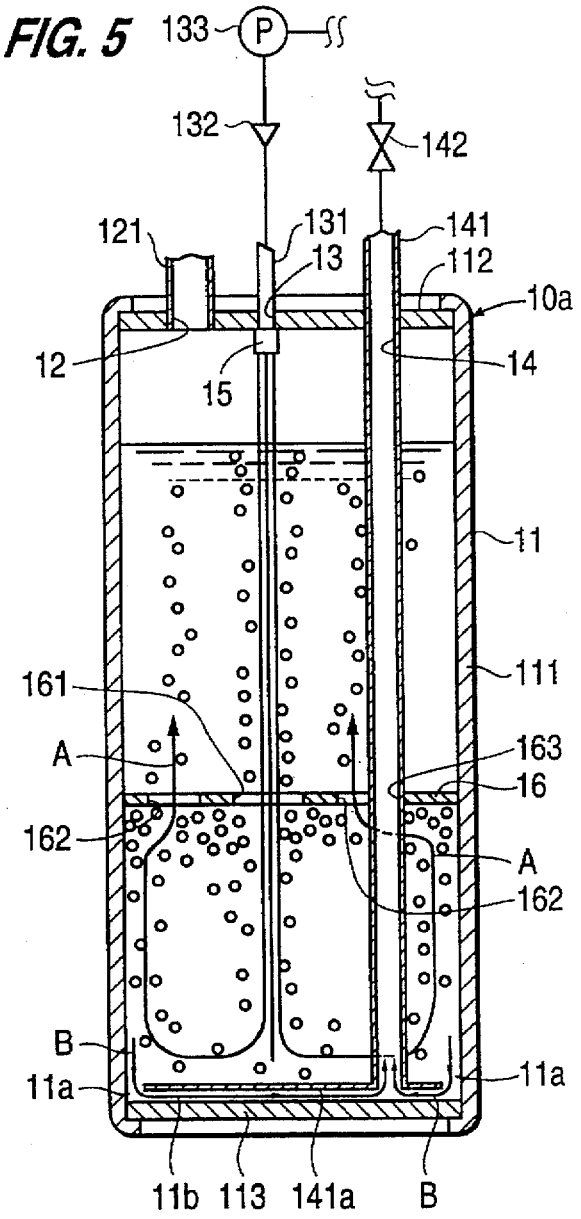
FIG. 5 is an overall longitudinal cross-sectional view of a device for producing carbonated water in accordance with a second embodiment of the present invention.

FIG. 5 illustrates an overall construction of a carbonater 10*a* in accordance with a second embodiment of the present invention. In the drawing, the same numerals are used to denote the corresponding elements shown in FIG. 1 so that an explanation thereof is omitted.

With reference to FIG. 5, a circular plate member 16 made of, for example, stainless steel is disposed within the container 11 at a certain location which is lower than the above-mentioned first boundary value. Preferably, the circular plate member 16 is positioned at a location which is slightly lower than one-half of height of the container 11. The circular plate member 16 and the container 11 are fixedly connected to each other by a well-known manner, for example, spot welding.

Figure 6:
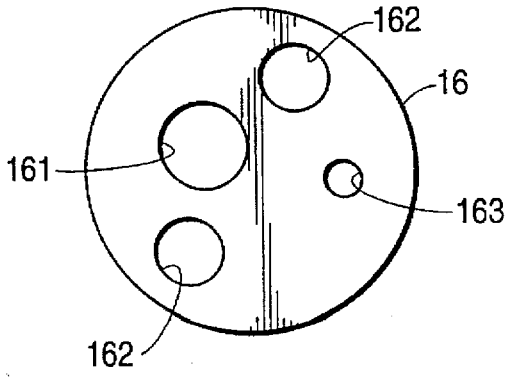
FIG. 6 is a top view of a circular plate member shown in FIG. 5.
Figure 7:
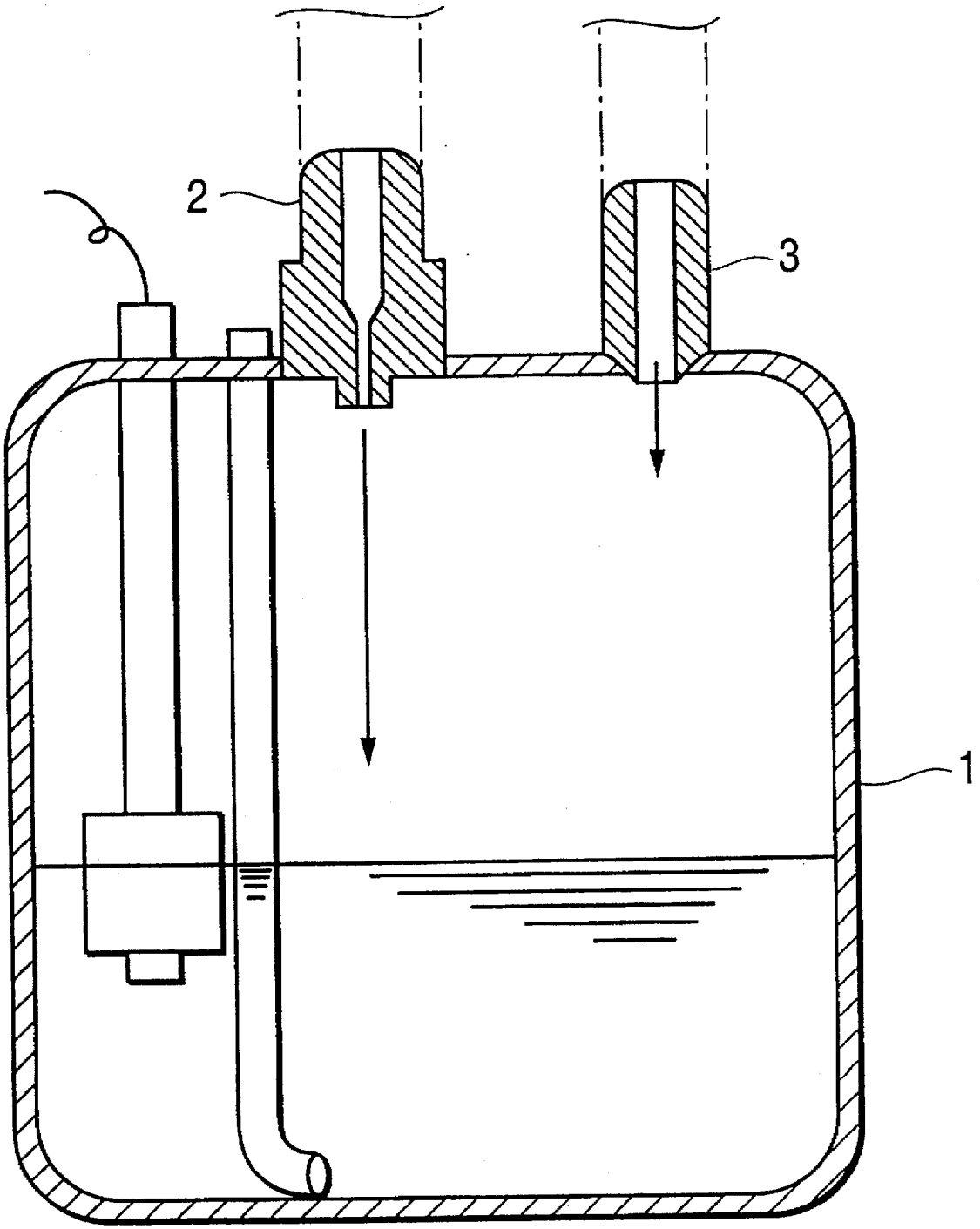
FIG. 7 is an overall longitudinal cross-sectional view of a prior art device for producing carbonated water.

A single first circular hole 161, a pair of second circular holes 162, and a single third circular hole 163 are formed through the circular plate member 16. As illustrated in FIG. 6, the location of the first hole 161 is arranged to correspond to a later-mentioned downward path of the injected water through the temporarily staying water in the container 11. The location of the pair of second holes 162 is arranged to be offset from some of the later-mentioned upward paths of the injected water through the temporarily staying water in the container 11, in a certain amount. The location and diameter of the third hole 163 is arranged and designed such that the third pipe member 141 is fittingly received thereby.

The relevant part of the operation of carbonater 10*a* of the second embodiment is described below. As long as the incoming tap water flows from the water service pipe (not shown) to the container 11 through the second pipe member 131, the pressurized water is downwardly injected into the inner hollow space of the container 11 through the nozzle 15, and is thrust into the water, which has already been injected and is temporarily staying in the container 11. Thereafter, the injected water moves through the temporarily staying water in the container 11 as indicated by arrows "A" in FIG. 5 by virtue of the inertia thereof.

In detail, the injected water initially moves downwardly, and then passes through the first hole 161 of the circular plate member 16 with no substantial interference with the circular plate member 16. The injected water which has passed through the first hole 161 further moves downwardly until it reaches the circular discoid portion 141*a* of the third pipe member 141. Once the injected water reaches the circular discoid portion 141*a*, it turns to a horizontal direction, and then moves horizontally outwardly in various radial directions along the upper end surface of the circular discoid portion 141*a* until it reaches an inner peripheral surface of cylindrical portion 111 of the container 11. Once the injected water reaches the inner peripheral surface of cylindrical portion 111 of the container 11, it turns to the upward direction, and then moves upwardly along the inner peripheral surface of cylindrical portion 111 of the container 11.

The injected water moving upwardly from the circular discoid portion 141*a* of the third pipe member 141 along the inner peripheral surface of cylindrical portion 111 of the container 11 is turned to the horizontal direction at the circular plate member 16, and then flows into the pair of second holes 162. The injected water passes through the second holes 162 and then continues moving upwardly to the top surface of the temporarily staying water.

As described above, the upward path of the injected water through the temporarily staying water in the container 11 is intentionally interfered by the circular plate member 16. As a result, the entire moving path of the injected water through the temporarily staying water in the container 11 is elongated.

Accordingly, the time period for which the water and the carbonic acid gas are dynamically in contact with each other is effectively elongated, so that the carbonic acid gas can be sufficiently dissolved in the water.

Furthermore, in place of the nozzle 15 of the first embodiment, any type of the nozzle, such as the conventional nozzle discussed in the description of the prior art may be employed in the carbonater 10*a*.

Still furthermore, the location and the number of the second holes 162 are not restricted to those of the second embodiment. They can be freely arranged and selected as long as the upward movement of the injected water through the temporarily staying water is sufficiently interfered by the circular plate member 16 so as to elongate the flow path of the injected water.

This invention has been described in connection with the preferred embodiments. These embodiments, however, are merely for example only and the invention is not restricted thereto. It will be understood by those skilled in the art that variations and modifications can easily be made within the scope of this invention as defined by the appended claims.

I claim:

1. A device for producing carbonated water including;

a hermetic container, a first pipe member continually conducting carbonic acid gas into an inner hollow space of said hermetic container, a second pipe member intermittently conducting pressurized water into said inner hollow space of said hermetic container in response to demand, a third pipe member intermittently conducting carbonated water temporarily staying in said container to a location exterior to said container in response to demand, a nozzle connected to one end of said second pipe member and disposed within said container at a position which is located at a top end of said container, said nozzle allowing pressurized water to be downwardly injected into said inner hollow space of said container, and a plate member disposed within said inner hollow space of said container, wherein said plate member includes a first hole which is located at a position corresponding to a downward path of said injected water, and at least one second hole which is located at a position offset from an upward path of said injected water.

2. The device for producing carbonated water of claim 1 wherein said at least one second hole comprises two holes.

3. The device for producing carbonated water of claim 1 wherein said third pipe member includes a flat discoid portion formed at one end thereof.

4. The device for producing carbonated water of claim 3 wherein said discoid portion of said third pipe member is arranged to be located at a position adjacent to a bottom end of said container and to be generally parallel to said bottom end of said container.

5. The device for producing carbonated water of claim 1 wherein said nozzle has a plurality of holes which allow the pressurized water to be downwardly injected into said inner hollow space of said container.

6. The device for producing carbonated water of claim 5 wherein the number of said holes is three.

7. The device for producing carbonated water of claim 6 wherein said holes are arranged to be spaced from one another in equiangular intervals.

* * * * *